US006435060B1

(12) United States Patent
Izumisawa

(10) Patent No.: US 6,435,060 B1
(45) Date of Patent: Aug. 20, 2002

(54) RATCHET WRENCH

(75) Inventor: Nobuyuki Izumisawa, Tokyo (JP)

(73) Assignee: Kabushiki Kaisha Shinano Seisakusho, Tokyo (JP)

( * ) Notice: Subject to any disclaimer, the term of this patent is extended or adjusted under 35 U.S.C. 154(b) by 98 days.

(21) Appl. No.: 09/691,559

(22) Filed: Oct. 18, 2000

(51) Int. Cl.[7] ..... B25B 13/46
(52) U.S. Cl. ..... 81/57.39; 81/57.26
(58) Field of Search ..... 81/57.11, 57.26, 81/57.39, 60

(56) References Cited

U.S. PATENT DOCUMENTS

| | | | | | |
|---|---|---|---|---|---|
| 4,748,872 | A | * | 6/1988 | Brown | 81/57.26 |
| 5,022,289 | A | * | 6/1991 | Butzen | 81/57.39 |
| 5,142,952 | A | * | 9/1992 | Putney et al. | 81/57.39 |
| 5,784,934 | A | * | 7/1998 | Izumisawa | 81/57.26 |
| 6,298,753 | B1 | * | 10/2001 | Izumisawa | 81/57.39 |

* cited by examiner

*Primary Examiner*—Joseph J. Hail, III
*Assistant Examiner*—Joni B. Danganan

(74) *Attorney, Agent, or Firm*—Jordan and Hamburg LLP

(57) ABSTRACT

A ratchet wrench includes a handle and a head. The handle has a motor accommodated within. The head is provided with a ratchet mechanism having a rotary tightening member which is to be rotated by drive power from the motor. A pin extends in a transverse direction with respect to the axis of the handle so as to connect the head with the handle. A crankshaft is connected to an output shaft of the motor. A crankpin of the crankshaft is rotatably fitted into a first drive bush. The first drive bush is fitted into a first drive member such that the first drive bush is slidable in the transverse direction. The first drive member is connected to the pin in such a manner that the first drive member is rotatable about the pin and slidable along the pin. A second drive member is connected to the pin in such a manner that the second drive member is rotatable about the pin and slidable together with the first drive member along. the pin. The second drive member is fitted into a second drive bush so as to be slidable in a direction parallel to the axis of the head. A yoke is connected to the second drive bush in such a manner that the yoke is swingable relative to the second drive bush and is connected to the rotary tightening member via the ratchet mechanism.

4 Claims, 3 Drawing Sheets

RATCHET WRENCH

BACKGROUND OF THE INVENTION

1. Field of the Invention

The present invention relates to a ratchet wrench, and particularly to a head-tiltable-type ratchet wrench whose head can be tilted relative to a handle.

2. Background of the Invention

Japanese Patent Application Laid-Open (kokai) No. 10-217140 discloses a conventional ratchet wrench having a rotatable head.

In the disclosed ratchet wrench, upon operation of a lever, pressurized air is fed to a motor, so that the motor operates. The motor rotates a drive member, which in turn rotates a first bevel gear. The first bevel gear rotates a third bevel gear via a second bevel gear. The third bevel gear rotates a drive shaft to which a socket is fixed, so that the socket rotates to tighten or loosen a threaded fastening element. Upon release of the lever, the feed of the air to the motor is stopped and the drive shaft stops its rotation. When the position of the head is changed relative to the handle, a pin is moved to a release position, and the head is pivoted to a selected position. As described above, the conventional ratchet wrench includes a plurality of bevel gears provided between the head and the handle so as to enable pivoting of the head in a plane containing the axis of the handle.

Need for a ratchet wrench which can tighten or loosen a threaded fastening element at a difficult-to-access location has become stronger, as has need for a ratchet wrench which permits an operator to insert the ratchet wrench into a narrower space than in the case of the conventional ratchet wrench currently in use.

In order to insert a ratchet wrench into a narrower space, the head, which is a rotatable or tiltable portion, of a ratchet wrench is desired to be as short as possible. Since the conventional ratchet wrench disclosed in the abovedescribed patent publication has the bevel gears between the head and the handle, the head cannot be shortened.

SUMMARY OF THE INVENTION

In consideration of the above-described problem of the conventional ratchet wrench, an object of the present invention is to provide a ratchet wrench whose head can be made shorter in order to enable insertion into narrower spaces.

The present invention provides a ratchet wrench comprising: a handle within which a motor Is accommodated; a head provided with a ratchet mechanism having a rotary tightening member which is to be rotated by drive power from the motor; a pin extending in a transverse direction with respect to the axis of the handle so as to connect the head with the handle; a crankshaft connected to an output shaft of the motor; a first drive bush into which a crankpin of the crankshaft is rotatably fitted; a first drive member into which the first drive bush is fitted to be slidable in a direction substantially perpendicular to the axis of the pin, the first drive member being connected to the pin in such a manner that the first drive member is rotatable about the pin and slidable along the pin; a second drive member connected to the pin in such a manner that the second drive member is rotatable about the pin and slidable together with the first drive member along the pin; a second drive bush into which the second drive member is fitted so as to be slidable in a direction parallel to the axis of the head; and a yoke which is connected to the second drive bush in such a manner that the yoke is swingable relative to the second drive bush, the yoke being connected to the rotary tightening member via the ratchet mechanism.

The ratchet wrench of the present invention enables a worker to tighten or loosen a bolt, nut, or other fastening element in a state in which the head is directed to a desired angular direction.

Preferably, the ratchet wrench of the present invention further includes a tilt mechanism which locks the head at an angle selected from a plurality of angles relative to the axis of the handle. The head is securely locked to the handle, so that a bolt or nut within a small space is tightened or loosened securely and easily.

Preferably, the tilt mechanism includes an engagement member having a toothed portion, the engagement member being fixed to the head and rotatably connected to the pin; and a lock pin which is disposed in a front portion of the handle and is engaged with the engage member so as to lock the head. This structure enables a worker to direct the head to a desired angular direction through a simple operation of holding the handle in one hand and the head in the other hand and bending the ratchet wrench about the axis of the pin.

Preferably, the crankshaft is connected to the motor via a reduction gear mechanism.

DESCRIPTION OF THE PREFERRED EMBODIMENT

An embodiment of the present invention will be described in detail with reference to the drawings.

Figure 1:
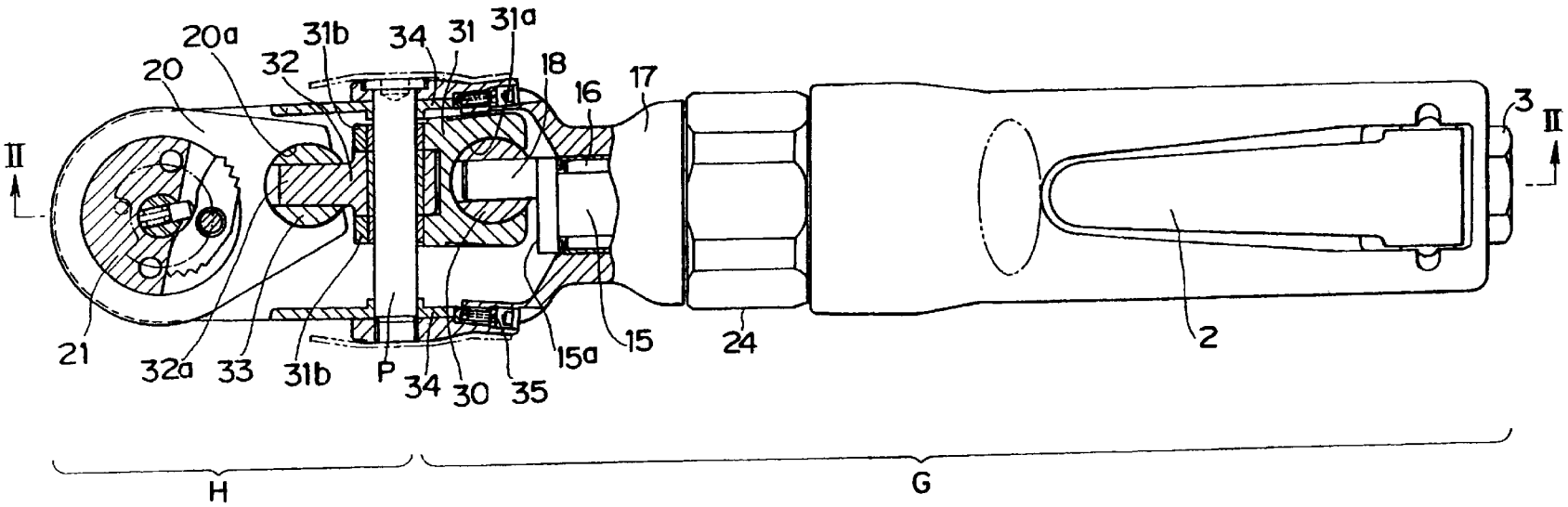
FIG. 1 is a front view of the ratchet wrench according to an embodiment of the present invention.
Figure 2:
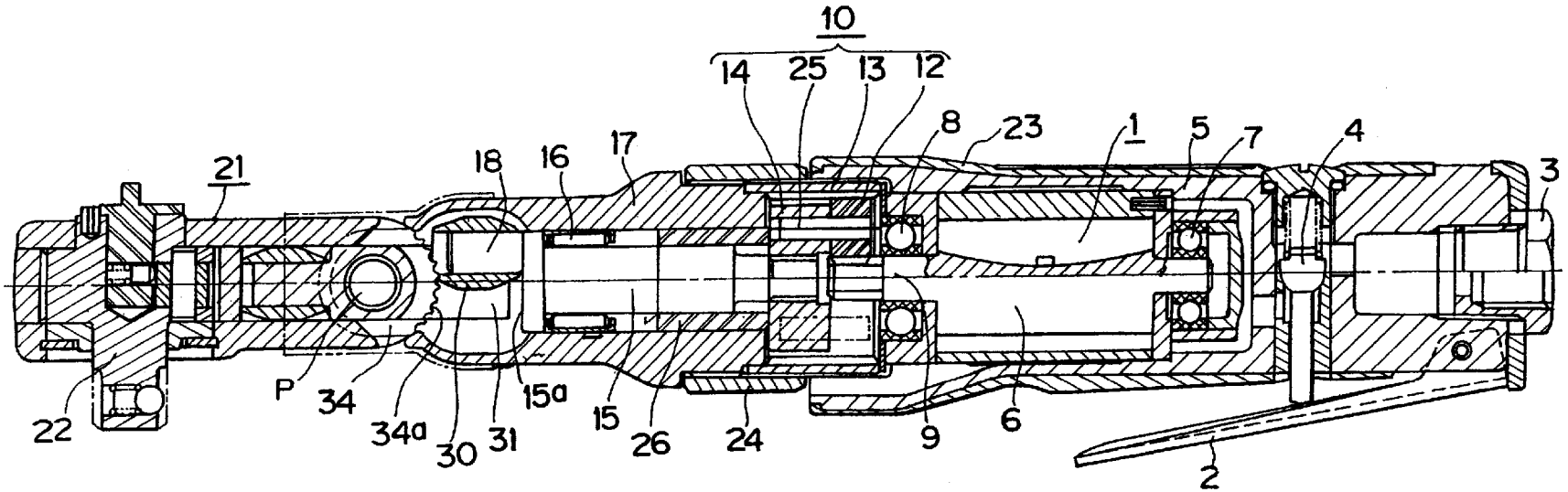
FIG. 2 is a sectional view of the ratchet wrench taken along line II—II in FIG. 1.
Figure 3:
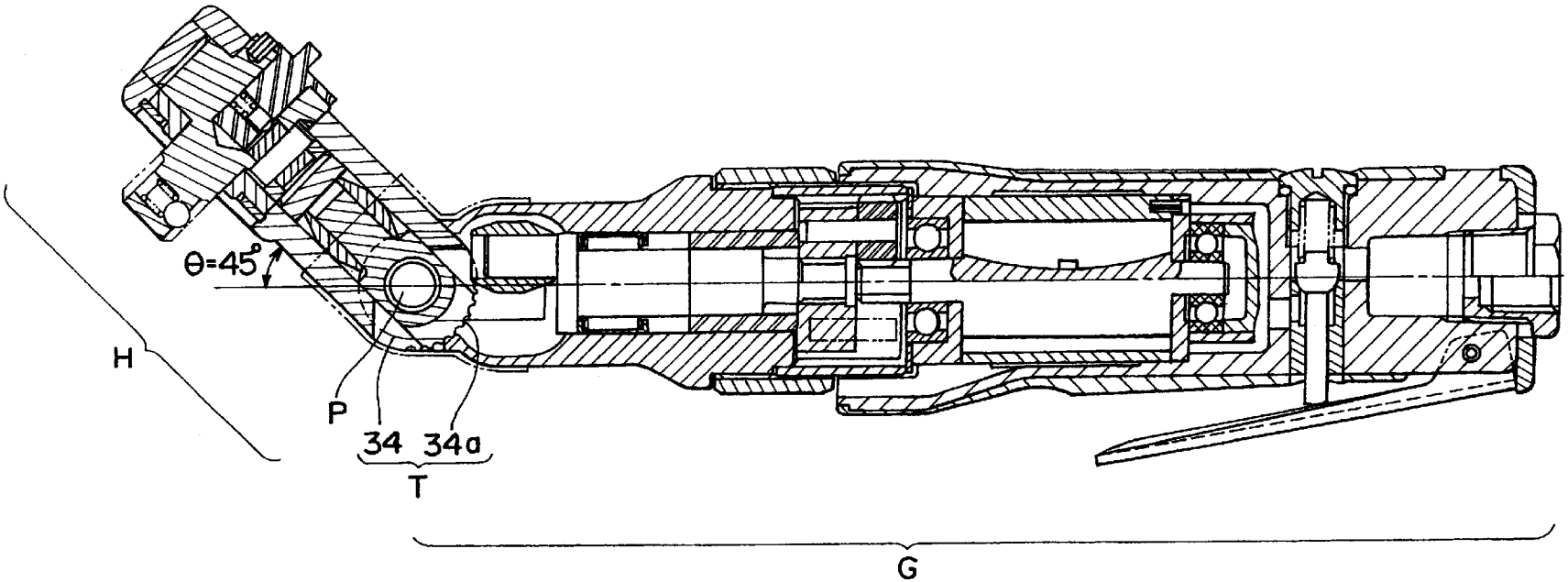
FIG. 3 is a sectional view of the ratchet wrench with the head being tilted at an angle $\theta=45°$.

FIG. 1 is a front view of a ratchet wrench according to an embodiment of the present invention, a portion of which is sectioned in order to show the internal structure thereof. FIG. 2 is a sectional view of the ratchet wrench taken along line II—II in FIG. 1. FIG. 3 is a sectional view of the ratchet wrench whose head is tilted at 45° with respect to the axis of a handle.

As shown in the drawings, the ratchet wrench includes a handle G, a head H, and a pin P. The handle G has a motor 1 accommodated therein. The head H is provided with a ratchet mechanism 21 including a rotary tightening member 22 which is operated by drive power from the motor 1. The pin P extends in a transverse direction of the handle G and connects the handle G with the head H. In the present embodiment, the motor 1 is an air motor. However, the present invention can be applied to an electrically-driven ratchet wrench.

Upon operation of an open-close lever 2, the air motor 1 is operated by pressurized air fed from an air induction port 3 via an open-close valve 4, so that a shaft 9 of the air motor 1 rotates. A motor housing 5 is covered with a body cover 23, which serves as a grip of the ratchet wrench. The body cover 23 is preferably formed of resin.

In the air motor 1, a rotor 6 is rotatably supported by bearings 7 and 8 fixed to the motor housing 5. The shaft 9 is rotatably supported by the bearing 8. The tip end of the shaft 9 is in engagement with a reduction gear mechanism 10.

The reduction gear mechanism 10 includes three idle gears 12, an internal gear 13, and a cage 14. The idle gears 12 are in meshing-engagement with the shaft 9. The internal gear 13 is in meshing-engagement with the idle gears 12 and is fixed into a driver housing 17, which is coupled with the motor housing 5 by way of a lock ring 24. The cage 14 is coupled to each of the idle gears 12 via a respective idle pin 25 and is in engagement with a crankshaft 15.

In the present embodiment, the three idle gears 12 are disposed around the shaft 9. Each of the idle gears 12 is rotatably fixed onto the corresponding idle pin 25. The cage 14 is fixed to the idle pins 25 (three idle pins in the present embodiment), so that when the idle gears 12 revolve around the shaft 9, the cage 14 rotates about its axis and the crankshaft 15 rotates.

In the driver housing 17, one end of the crankshaft 15 located on the side of the reduction gear mechanism 10 is rotatably supported by a bush 26, and the other end located on the side of a ratchet mechanism 21 (described later) is rotatably supported by a needle bearing 16.

The crankshaft 15 has a crank pin 18 projecting from a tip end surface 15*a* at an eccentric position. The crank pin 18 is rotatably fitted into a first drive bush 30. The first drive bush 30 is fitted in a groove 31*a* of a first drive member 31 such that the first drive bush 30 is slidable along the groove 31*a* (in the direction perpendicular to the sheet in FIG. 1). The first drive member 31 is connected to the pin P such that the first drive member 31 is slidable along the pin P and is rotatable about the pin P.

The first drive member 31 includes forked connecting portions 31*b* which are connected to the pin P. The second drive member 32 is disposed between the connecting portions 31*b* and is rotatably connected to the pin P in such a manner that the second drive member 32 is slidable together with the drive member 31.

A drive pin 32*a* of the second drive member 32 is fitted into a second drive bush 33 such that the drive pin 32*a* is slidable in a direction parallel to the axis of the head. The second drive bush 33 is fitted into a recess 20*a* of a yoke 20, so that the drive pin 32*a* is swingable relative to the yoke 20. The yoke 20 is connected to a rotary tightening member 22 via the ratchet mechanism 21.

The ratchet wrench is provided with a tilt mechanism T which locks the head H at an angle selected from a plurality of angles to which the head H can be tilted relative to the handle G through pivoting motion about the pin P.

The tilt mechanism T includes a pair of tilt covers 34 and a pair of lock pins 35. The tilt covers 34 are fixed to upper and lower side surfaces of the head H (in FIG. 1) and are supported by the pin P at the opposite ends thereof. Each of the tilt covers 34 has a toothed portion 34a formed on the rear portion thereof. The lock pins 35 are embedded in the front end portion at positions corresponding to those of the tilt covers 34. Each lock pin 35 is pressed against the toothed portion 34*a* of the corresponding tilt cover 34.

In the present embodiment, the toothed portion 34*a* includes nine grooves formed at intervals of 11.25° about the axis of the pin P. Therefore, the head can be tilted relative to the handle G at an angle selected from nine angles; i.e., 0° (horizontal position), −11.25°, −22.5°, −33.75°, −45°, +11.25°, +22.5°, +33.75°, and +45° ("−" indicates the downward direction and "+" indicates the upward direction in FIG. 3).

FIG. 3 shows a state in which the head H has been tilted upward to the angle θ=+45°.

When an object, such as a bolt or nut, is tightened by use of the ratchet wrench having the above-described structure, the head H is directed to a desired angle direction relative to the handle G, the rotary tightening member 22 is engaged with the object, and the open-close lever 2 is operated. As a result, the air motor 1 operates, and the shaft 9 rotates together with the rotor 6.

The rotation speed of the shaft 9 is reduced through the reduction gear mechanism 10. The rotational motion of the shaft 9 is transmitted to the first drive member 31 and the second drive member 32 via the crankshaft 15 and is converted to a reciprocating motion along the pin P. The reciprocating motion of the second drive member 32 is transmitted to the yoke 20, so that the yoke 20 swings repeatedly. The swinging motion of the yoke 20 is converted to rotational motion of the rotary tightening member 22, whereby the bolt or nut is tightened.

What is claimed is:

1. A ratchet wrench comprising:

a handle within which a motor is accommodated;

a head provided with a ratchet mechanism having a rotary tightening member which is to be rotated by drive power from the motor;

a pin extending in a transverse direction with respect to the axis of the handle so as to connect the head with the handle;

a crankshaft connected to an output shaft of the motor;

a first drive bush into which a crankpin of the crankshaft is rotatably fitted;

a first drive member into which the first drive bush is fitted to be slidable in a direction substantially perpendicular to the axis of the pin, the first drive member being connected to the pin in such a manner that the first drive member is rotatable about the pin and slidable along the pin;

a second drive member connected to the pin in such a manner that the second drive member is rotatable about the pin and slidable together with the first drive member along the pin;

a second drive bush into which the second drive member is fitted so as to be slidable in a direction parallel to the axis of the head; and a yoke which is connected to the second drive bush in such a manner that the yoke is swingable relative to the second drive bush, the yoke being connected to the rotary tightening member via the ratchet mechanism.

2. A ratchet wrench according to claim 1, including a tilt mechanism which locks the head at an angle selected from a plurality of angles relative to the axis of the handle.

3. A ratchet wrench according to claim 2, wherein the tilt mechanism includes an engagement member having a toothed portion, the engagement member being fixed to the head and rotatably connected to the pin; and a lock pin which is disposed in a front portion of the handle and is engaged with the engage member so as to lock the head.

4. A ratchet wrench according to claim 1, wherein the crankshaft is connected to the motor via a reduction gear mechanism.

* * * * *